United States Patent [19]

Nicholson

[11] 4,284,865

[45] Aug. 18, 1981

[54] THROTTLE FORCE DETECTOR

[75] Inventor: Gordon E. Nicholson, Cedar Rapids, Iowa

[73] Assignee: Rockwell International Corporation, El Segundo, Calif.

[21] Appl. No.: 52,168

[22] Filed: Jun. 26, 1979

[51] Int. Cl.[3] ..... H01H 9/06

[52] U.S. Cl. ..... 200/157; 200/61.85; 200/153 H; 200/153 T; 200/332

[58] Field of Search ..... 200/61.85, 61.87, 61.88, 200/61.89, 61.90, 61.91, 330, 332, 335, 336, 337, 338, 329, 153 H, 153 T, 157, 155 R

[56] References Cited

U.S. PATENT DOCUMENTS

| | | | |
|---|---|---|---|
| 1,985,808 | 12/1934 | Suiter | 200/157 |
| 2,049,145 | 7/1936 | Warren et al. | 200/157 |
| 3,115,555 | 12/1963 | Lescarbourg | 200/153 T |
| 3,283,088 | 11/1966 | Scow et al. | 200/157 |
| 3,790,729 | 2/1974 | Bradshaw | 200/61.88 |
| 3,859,489 | 1/1975 | Tomlinson | 200/157 |
| 3,894,207 | 7/1975 | Jelley | 200/61.85 |
| 3,988,574 | 10/1976 | Peitsmeier | 200/157 |

FOREIGN PATENT DOCUMENTS

| | | | |
|---|---|---|---|
| 734193 | 7/1955 | United Kingdom | 200/157 |

*Primary Examiner*—John W. Shepperd
*Attorney, Agent, or Firm*—Edward A. Gerlaugh; Richard A. Bachand; H. Frederick Hamann

[57] ABSTRACT

In an autothrottle system for multiengine aircraft having separate throttle servos for each engine and servo tracking means for detecting and compensating for servo drift during autothrottle mode of operation, a pressure sensitive switch on each throttle handle for temporarily disengaging the autothrottle system and establishing a new reference for servo tracking means in response to manual adjustment of throttles by the pilot.

4 Claims, 8 Drawing Figures

THROTTLE FORCE DETECTOR

STATEMENT OF GOVERNMENT INTEREST

The present invention was made under a Government contract and may be made or used by or on behalf of the Government without the payment of any royalties thereon or therefor.

The Government has the rights in this invention pursuant to Contract No. DOT-CG-50152-A awarded by the United States Coast Guard.

BACKGROUND OF THE INVENTION

The invention relates to aircraft flight control systems, and, more particularly to automatic throttle-position tracking apparatus for multiengine aircraft.

Existing autothrottle systems which are used to drive two or more throttles utilize a single servomotor driving a mechanical clutch arrangement, which in turn, drives the several throttles. The clutch drives all of the throttles universally and equally in response to the servomotor input; however, each of the throttles may also be manually driven independently of each of the other throttles in response to a separate input to the clutch from each of several throttle control levers or handles, which handles are manipulable by the pilot of the aircraft. Each of the inputs to the clutch from the throttle control handles overrides, individually, the universal input from the servomotor. The throttles may thus be controlled individually by the pilot, or in unison by a flight control system through the servomotor input to the clutch.

The aforedescribed system has the disadvantage of requiring that the clutch mechanism and servomotor be located in the throttle quadrant of the aircraft cockpit. Such mechanical clutches are bulky and cumbersome, making access thereto difficult in the less than spacious environment of an aircraft cockpit. Further, lengthy mechanical linkages between the servo and the engine throttle mechanisms tend to introduce backlash and dead zones into the control loop, thus degrading loop performance.

When the pilot overrides the servomotor input to the prior art clutch mechanism by manually operating the throttle control handles, it may become apparent to him through tactile sensation or other sensory indication that an anomaly exists in the autothrottle system, e.g., the servomotor input may immediately begin, incorrectly, to compensate for the pilot's manual adjustment of one or more of the throttles. Upon such awareness, the pilot would of course disengage the autothrottle system by actuating any one of several switches located conveniently, as for example, on an overhead control panel. The prior art autothrottle systems, because of the already crowded space around the throttle quadrant do not provide a disengage switch in the most convenient of locations, on the throttle handle itself.

When two or more rate servos are commanded together such as in a multiengine aircraft having an autothrottle system with a separate throttle servo for each engine, the servos will tend to drift and thus not maintain accurate positional relationship with respect to one another. Moreover, when commanded by the autothrottle system to advance or retard the throttles in synchronism, multiple servos also drift apart positionally with respect to one another because the integration rates are not precisely the same for all the servos. Since it is desirable to utilize rate servos in autothrottle applications, means must be provided for compensating for the aforementioned drift, thereby causing all the servos, and in turn the throttles and throttle handles, to act as if they were one. Otherwise stated, when the pilot manually positions the several throttle control handles to a desired positional alignment, each with respect to the others, and then activates the autothrottle mode of operation as by removing his hand from the throttle handles, the throttles must be advanced or retarded simultaneously and in unison by the servos in response to control signals from the autothrottle system, maintaining precisely the relative positional alignments originally established by the pilot.

SUMMARY OF THE INVENTION

It is a principal object of the invention to provide an improved autothrottle system for multiengine aircraft.

It is a more particular object of the invention to provide an improved autothrottle system for multiengine aircraft, which system is characterized by reduced weight and bulk of apparatus in the throttle quadrant of the cockpit.

Another object of the invention is to provide an improved autothrottle system for multiengine aircraft which significantly reduces backlash and dead zones characteristic of the prior art in the mechanical linkages between the throttle servo and the engine throttle mechanism.

Still another object of the invention is to provide an improved autothrottle system for multiengine aircraft having a separate throttle servo for each engine and including tracking means for compensating for drift inherent in the servos.

It is another object of the invention to provide an improved autothrottle system for multiengine aircraft, which system includes a separate throttle servo for each engine, servo tracking means for compensating for servo drift, and pressure sensitive switch means mounted on the cockpit throttle handles for temporarily disengaging the autothrottle system when the pilot manually adjusts the throttle handles.

Yet another object of the invention is to provide an improved autothrottle system having a disengage switch located conveniently on the throttle handle in a recessed location where accidental actuation is unlikely, but which is quickly and easily actuatable by the pilot without removing his hand from the throttle handle.

It is another object of the invention to provide a pressure sensitive switch in an autothrottle system for temporarily disengaging the throttle servos and establishing a positional reference for throttle tracking, which switch is mounted as an integral part of the throttle handle grasped by the pilot and is responsive to forward or backward pressure against the throttle lever.

Another object of the invention is to provide a pressure sensitive switch in a throttle handle which will respond positively to so slight a pressure from the hand of the pilot on the throttle control that the pilot is virtually unaware of any tactile sensation of switch actuation.

Still another object of the invention is to provide a pressure sensitive switch in a throttle handle which switch is responsive to force applied thereto from either of two opposing directions to actuate, and which further responds positively to release of the force to return to a neutral unactuated position.

In accordance with one aspect of the invention, a separate servo unit is provided for each engine of a multiengine aircraft. Each servo unit is coupled to the mechanical linkage between the throttle control handle in the cockpit and the throttle mechanism of the corresponding engine, at a location in or near the engine housing and remote from the throttle control handle. Each of the servos generates signals representative of the direction and magnitude of rotational displacement of the servomotor shaft from a selected starting point. Equalization circuit means responsive to the signals from at least two of the servos for throttle tracking, generates drive signals which are utilized to reposition the respective servomotors to their original relative positional alignment. A switch mounted on each of the throttle control handles, each switch being coupled to all of the servos, is responsive to the touch of the pilot to temporarily disengage the autothrottle system; each switch is coupled also to the equalization circuit means for establishing a reference of the relative positions of the throttle servos as set manually by the pilot, and, responsive to removal of the pilot's hand from the throttle handle, for reinitiating throttle tracking.

In accordance with a more detailed aspect of the invention, a cylindrical knob mounted on the end of the throttle handle includes a housing pivotally mounted on and moveable with respect to an end plate. Inside the housing and mounted on the end plate are an electrical switch, two pivots holding a switch actuating spring for bidirectional movement, and a return spring mechanism. An end cap of the housing has a momentary-contact switch mounted thereon outside the housing for easy access by the pilot, but recessed in the end cap to reduce the chance of accidental actuation.

BRIEF DESCRIPTION OF THE DRAWING

The invention is pointed out with particularity in the appended claims; however, other objects and features will become more apparent and the invention itself will best be understood by referring to the following description and embodiments taken in conjunction with the accompanying drawing, in which:

DESCRIPTION OF THE PREFERRED EMBODIMENT

Figure 1:
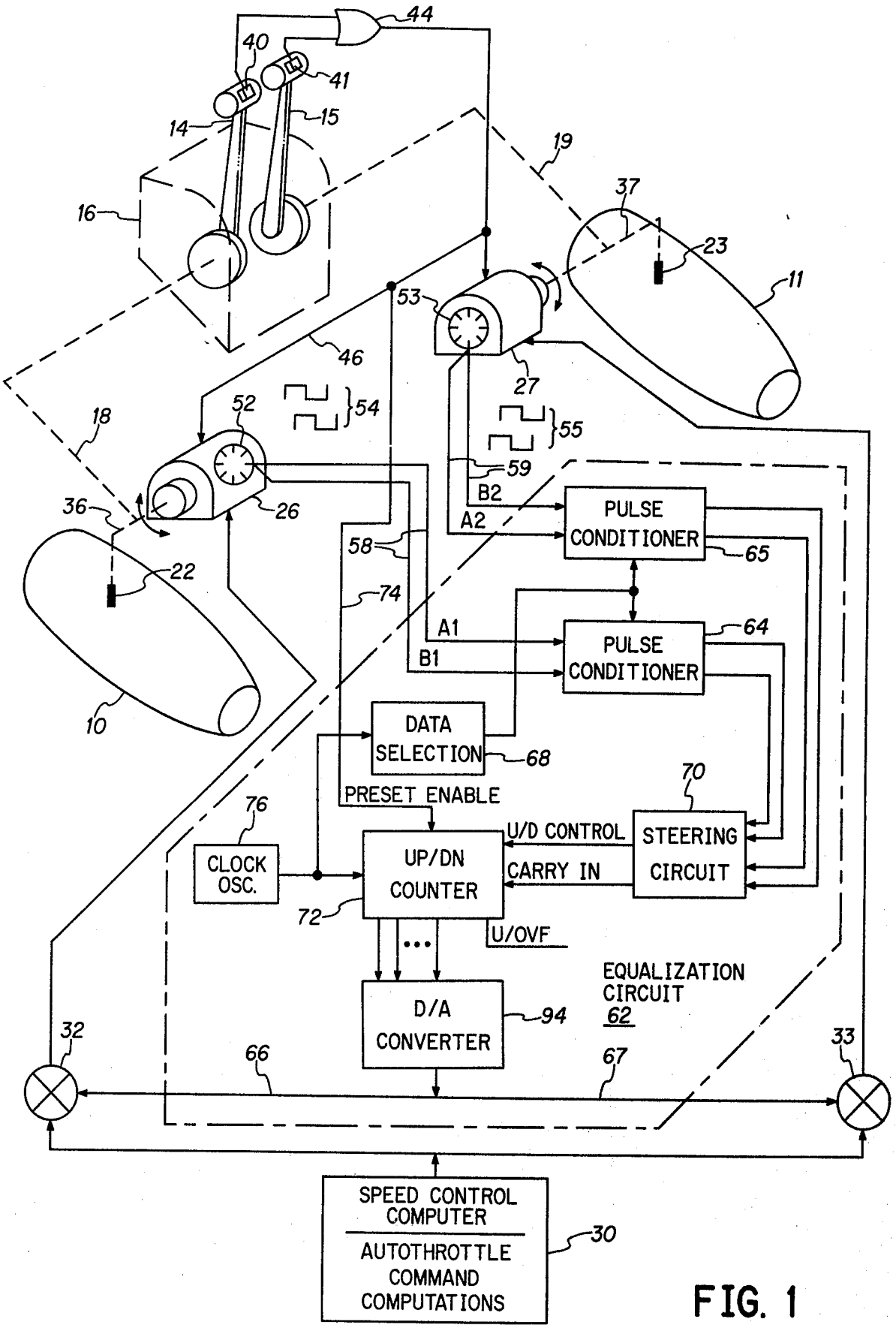
FIG. 1 is a functional block diagram of an improved autothrottle system in accordance with the instant invention.

Referring now to the various views of the drawing for a detailed description of the operation, construction and other features of the invention by characters of reference, FIG. 1 shows a diagram of a throttle control system of a multiengine aircraft. Associated with each of two engines 10, 11 of the aircraft are corresponding throttle control handles 14, 15 located in the throttle quadrant 16 of the aircraft cockpit. The throttle control handles 14, 15 are mechanically coupled by appropriate linkages 18, 19 to respective throttle mechanisms (not shown specifically, but indicated diagrammatically by reference numbers 22, 23) of the engines 10, 11. Coupled also in parallel between the engine throttles 22, 23 and the throttle control handles 14, 15 via the mechanical linkages 18, 19 are respective throttle servo units 26, 27, one for each of the engines 10, 11. A speed control computer 30 performs autothrottle command computations and generates outer loop control signals which are coupled via summing circuits 32, 33 to the throttle servo units 26, 27. The servos 26, 27 are responsive to the control signals from the speed control computer 30 by appropriate servomotor operation to advance or retard the engine throttles 22, 23 via those portions 36, 37 of the linkages 18, 19 between the servo units 26, 27 and the throttles 22, 23. Details of the mechanical linkages 18, 19 are not shown, but may be found in the literature and are quite familiar to those skilled in the art. Details of the operation of the flight control system including the speed control computer and the throttle servo loop generally are not required for a complete description of the instant invention even though these apparatus are peripherally germane to the invention. Such details also are published in the literature and are known to those skilled in art of aircraft flight control. Although the preferred embodiment of the invention is described with reference to a twin engine aircraft, it is understood that the invention is applicable as well to aircraft having more than two engines.

The throttle servo units 26, 27 are each located in or near the respective engine 10, 11 housing and remote from the throttle control handles 14, 15. Such location of the servo units 26, 27 makes the linkage portions 36, 37 between the servos 26, 27 and the throttles 22, 23 extremely short when compared with the overall length of the linkages 18, 19, thereby significantly reducing any dead zones or backlash in the linkages 36, 37 and facilitating a commensurate improvement in the autothrottle system loop performance.

Figure 2:
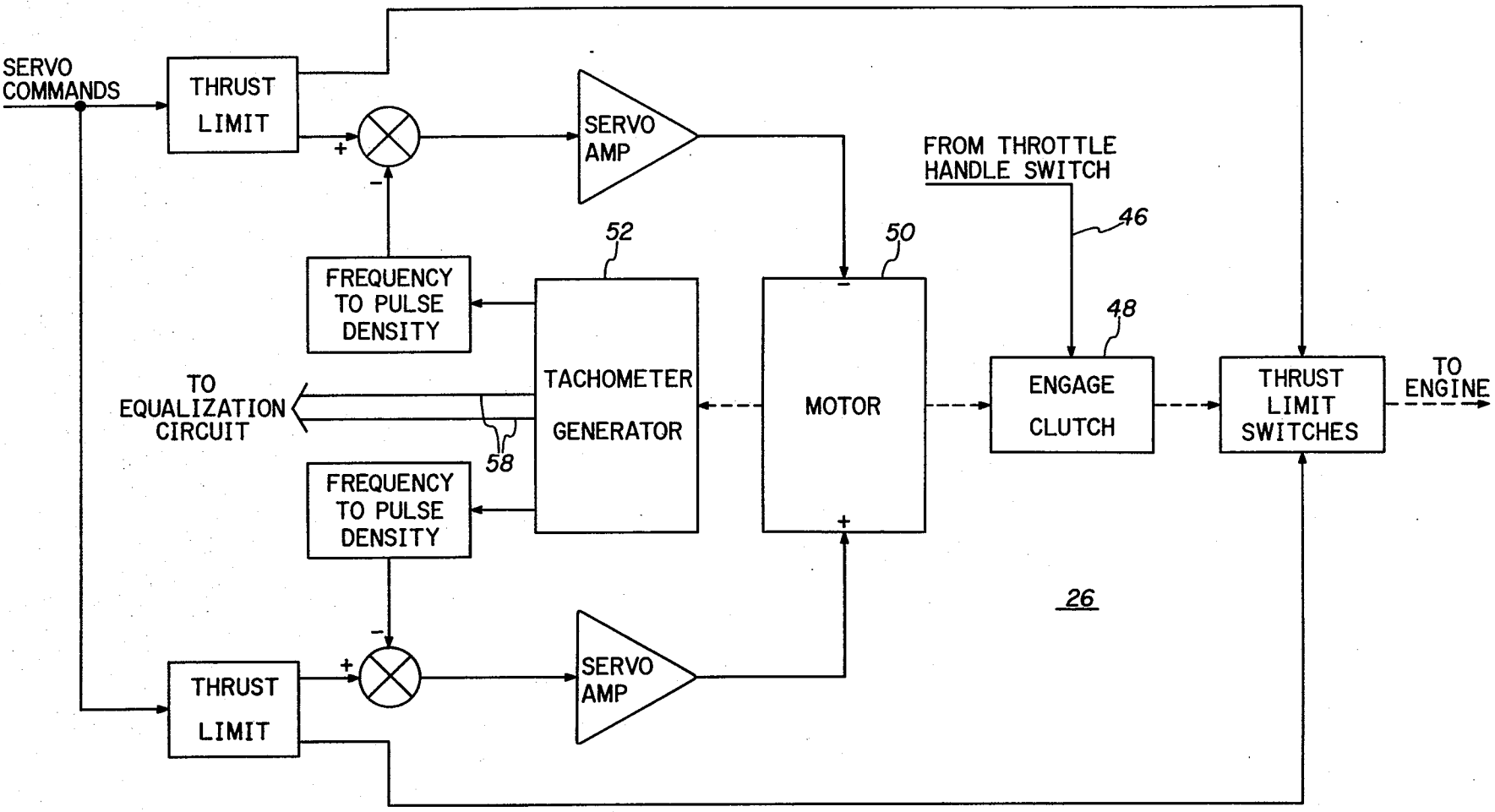
FIG. 2 is a detailed block diagram of a rate servo of the type which may be utilized in the practice of the present invention.

A switch 40, 41 is mounted in each of the throttle control handles. Each of the switches 40, 41 is responsive to a minimal pressure of the pilot's hand on the handle 14, 15 to actuate and supply a control signal via an OR logic element 44 and a lead 46 to each of the throttle servo units 26, 27. Referring briefly to FIG. 2, the servo unit illustrated is designated arbitrarily as the left servo unit 26 to facilitate the description. An engage clutch 48 of the servo unit 26 is responsive to the control signal received via the lead 46 to disengage servomotor 50 from the throttle linkage 36.

Referring now to FIGS. 1 and 2, a tachometer 52 is mechanically coupled to the servomotor 50 shaft. The tachometer 52 generates a signal 54 representative of the rate and direction of rotation of the servomotor 50. The tachometer 52 of the presently described embodiment is an incremental tachometer of the type which provides a fixed number of pulses for each revolution of the shaft, as for example by optoelectronic means. The signal 54 is generated as two pulse trains having the same repetition rates, but one pulse train shifted in phase by a predetermined amount with respect to the other in a direction, i.e., leading or lagging, depending on the direction of rotation of the servomotor 50. Incremental tachometers such as the tachometer 52 are known in the art and need not be described in detail herein. The pulse trains 54, 55 from each of the servos 26, 27 are coupled, respectively, via leads 58, 59, to an equalization circuit 62. The equalization circuit 62 in response to the pulsed signals 54, 55 received from the servo motors 26, 27, generates difference signals on leads 66, 67 which are representative of relative drift between the servos 26, 27. The difference signals are applied via the summing circuits 32, 33 to the servos 26, 27 which are responsive thereto to maintain the desired relative positional alignment between the servos 26, 27, while being at the same time responsive to outer loop control signals from the computer 30 to satisfy outer loop commands, as for example, for maintaining airspeed.

Referring still to FIG. 1, the tachometer pulse trains 54, 55 are regenerated by pulse conditioner circuits 64, 65, and under control of a multiplexer 68 the regenerated signals are coupled via a steering circuit 70 to an UP/DOWN counter 72. The counter 72 is responsive to the signals 54 to increment the count contained therein for a first direction of rotation of the servo 26 and to decrement the count for the opposite direction; conversely, the counter 72 is responsive to the signals 55 from the servo 27 to decrement the count for the first direction of rotation of the servo 27 (being the same direction as the first direction of the other servo 25) and to increment the count for the opposite direction of rotation.

The control signal from the sensors 40, 41 is applied via a lead 74 to a preset enable input of the counter 72. Actuation of either of the switches 40, 41 by the pilot causes the counter to be preset to a count which is in the middle of the range of the counter 72. The range of the counter 72 is selected such that underflow or overflow of the counter generates a U/OVF signal indicative of an anomaly in the equalization circuits or the autothrottle system. In any event the U/OVF signal is utilized to disable the autothrottle system and activate an appropriate sensory indication detectable by the pilot of the anomaly. The U/OVF signal is coupled to equalization monitor circuits of the flight control system (not shown). The range of the counter is selected such that overflow or underflow will occur within predetermined acceptable limits for drift of the throttle servos. The actual count will vary among different aircraft; in the instant embodiment overflow or underflow of the counter occurs when throttle displacement due either to drift of the servos or some other anomaly reaches approximately 4.4 degrees of throttle.

The counter 72 counts pulses coupled thereto from a clock circuit 76 which may be an oscillator operating at a frequency selected to be an appropriately large multiple of the maximum frequency of the tachometer output signals 54, 55, thereby providing adequate resolution of servomotor activity. In the presently described embodiment the clock 76 frequency is 30 kHz. The counter 72 is enabled to count up or down by the regenerated pulse trains 54, 55 coupled to the counter through steering circuit 70, under control of a data selection or multiplexer circuit 68. If servo drift occurs, the counter 72 develops a differential count which is representative of the positional difference between the two servos relative to a preestablished position there between. The digital number or count representative of a difference signal is detected in a D/A converter 94 and converted to a repositioning or analog error signal in a manner well known in the art. The repositioning signal is utilized to command the servomotor which was advanced, to retard, and the servomotor which was advanced, to retard, and the servomotor which was retarded, to advance and thus move the servomotors relative to each other so as to restore them to their original relative positional alignment.

The pressure sensitive switches 40, 41 are described in detail with reference to FIGS. 3–7. In the description supra the term "switch", while referring to a mechanically actuatable electrical switching element, has also been utilized to refer to generally and to include without specificity the mechanical elements of the knob mounted on the throttle control handle 14. In the ensuing detailed description distinction is made between the switch and the other various elements and structure of the knob assembly. Consequently, the reference numbers 40 and 41 do not appear in the description infra or in FIGS. 3–7. A convention utilized in the description infra calls the reader's attention, momentarily, to a specific drawing figure by parenthetical reference thereto. The general reference to drawing figure(s) for a portion of the description is set forth, without parenthesis, at the beginning of the portion.

Figure 3:
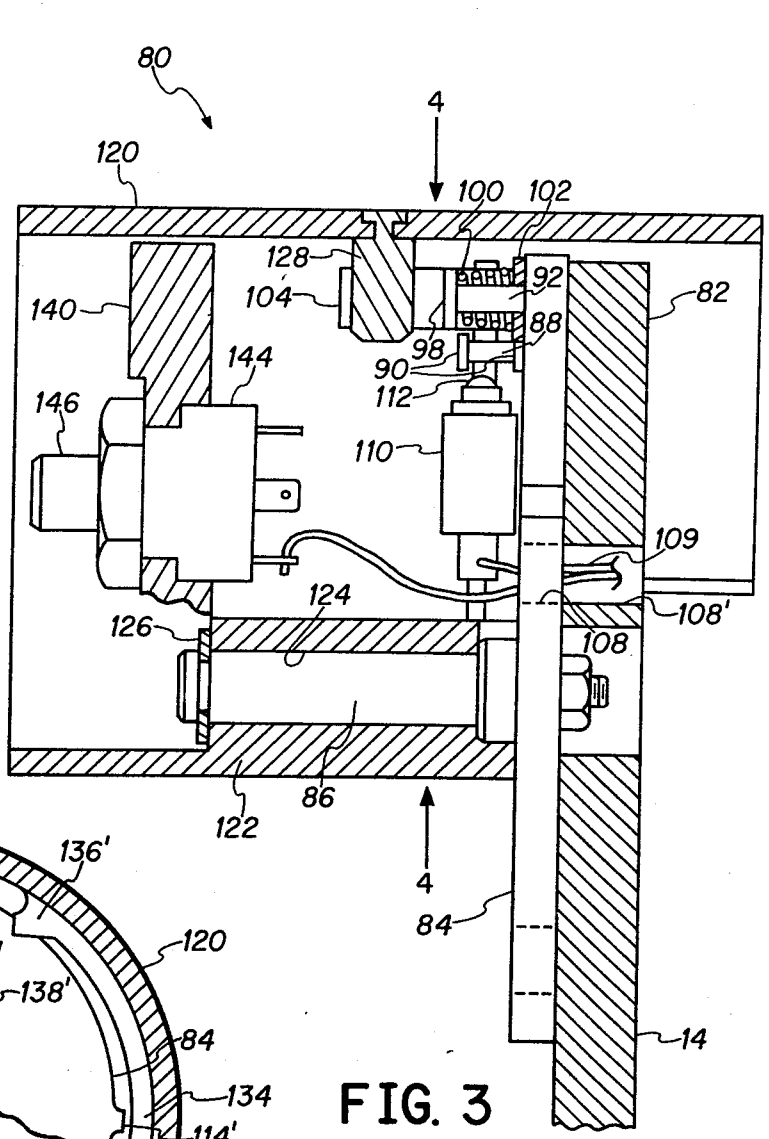
FIG. 3 is a modified sectional view of the throttle knob and switch mechanism of the present invention; the switch actuating spring has been omitted for clarity.
Figure 4:
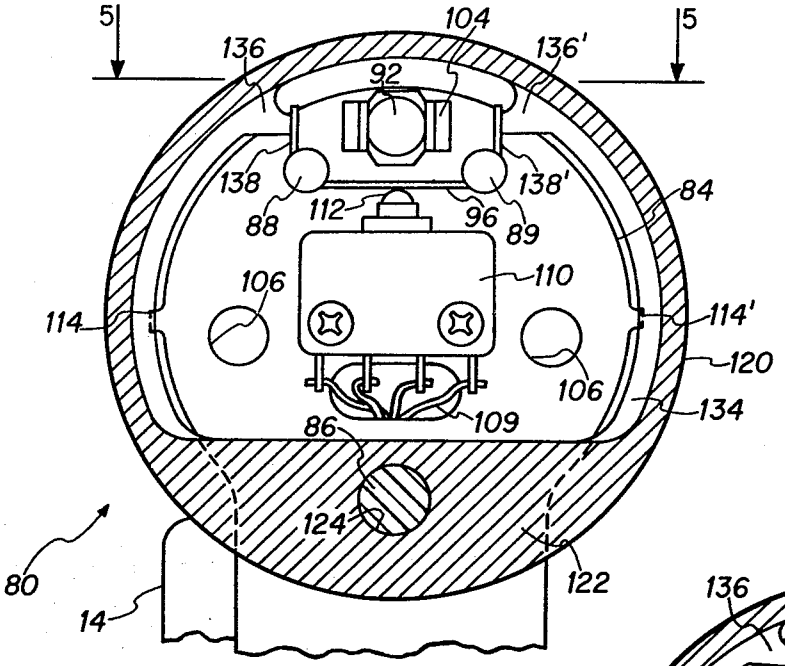
FIG. 4 is a modified sectional view taken generally along lines 4—4 of FIG. 3; the actuating spring is shown.
Figure 7:
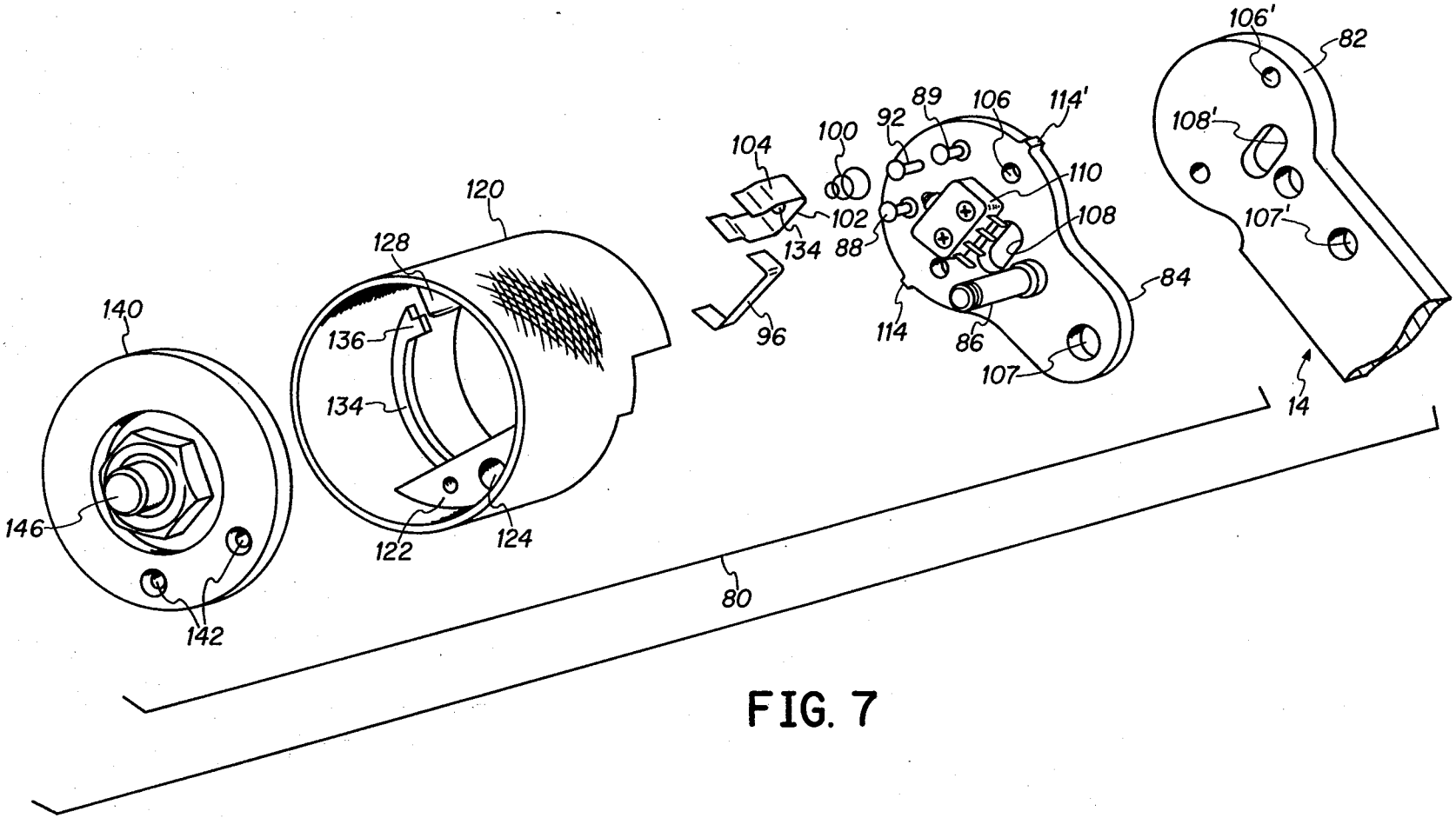
FIG. 7 is an exploded pictorial view of the knob assembly and pressure-sensitive switch of the present invention.

FIGS. 3, 4 and 7 show the throttle control handle 14 having a graspable knurled knob assembly 80 attached to an end 82 thereof. The knob assembly 80 includes an end plate 84 which is the primary structural member of the assembly 80, the end plate providing a means for mounting the knob assembly 80 to the throttle lever 14. Affixed to the plate 84 by any suitable fastening means (not shown) such as riveting or swageing are a pivot post 86, a pair of spring pivot pins 88, 89, and a coil-spring retaining pin 92. The pivot pins 88, 89 include flanged portions for holding and guiding a U-shaped actuating spring 96 (See FIGS. 4 and 7). The retaining pin 92 also includes a flanged portion 98 for holding a coil spring 100 in place between the flange 98 and a base 102 of a knob-tension spring 104. The end plate 84 is attached to the end 82 of the throttle control lever 14 by any suitable fastening means (not shown to preclude cluttering the drawing) such as rivets or bolts inserted through aligned apertures 106, 107 formed in the end plate 84 and 106', 107' in the handle end 82. In the best mode embodiment, blind-nut plates (not shown) are installed at the apertures 106 on the same side of the end plate 84 on which the switch 110 is mounted, thus facilitating easy installation of the knob assembly 80 onto the handle 14 using bolts passed in order through the apertures 106' of the handle 14, the apertures 106 of the end plate 84, and then the blink nuts. Apertures 108 in the end plate 84 and 108' in the handle end 82 facilitate passage of electrical wires 109 (See FIG. 4). A momentary-contact sensitive switch 110 is affixed to the end plate 84 by machine screws; an actuating plunger 112 of the switch 110 is oriented facing the flat, bottom portion of the U-shaped spring 96, and touches the spring 96 without being pushed or actuated thereby when no pressure is being applied to the knob assembly 80. The end plate 84 has formed on the edges thereof a pair of oppositely disposed nibs 114, 114' which function as mechanical stops as will be explained later.

The knob assembly 80 includes a cylindrical housing 120 having a thickened portion 122 thereof with an aperture 124 extending therethrough. The pivot post 86 of the end plate 84 fits into and extends through the aperture 124 in the knob housing 120, thus pivotally mounting the cylindrical housing 120 on the end plate 84. Any suitable means such as a retaining ring 126 may be utilized to hold the housing 120 mounted on the post 86. Referring now to FIGS. 3–5 and 7, the housing 120 includes a knob-tension pin 128 which is received between extended blades 130 of the knob-tension spring 104 (See FIG. 5). The knob-tension assembly 132 includes the spring 104 having an aperture 134 (See FIG. 7) therein through which the coil-spring retaining pin 92 passes during assembly of the apparatus. The base 102 of the knob-tension spring 104 is held flat against the face of the end plate 84 under tension exerted by the coil spring 100.

Figure 6:
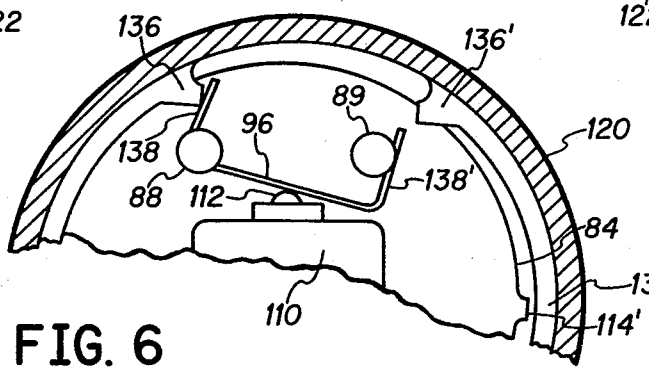
FIG. 6 shows the pressure-sensitive switch of the present invention in an actuated position; the knob-tension assembly is omitted for clarity.

Referring now to FIGS. 3, 4, 6 and 7, the housing 120 includes an internal flange 134 having actuating nibs 136, 136' with interiorly facing flat surfaces which rest upon the exteriorly facing flat surfaces of the blades 138, 138' of the U-shaped actuating spring 96. When the knob assembly is actuated by pressure of the pilot's hand, see FIGS. 6 and 4, the housing 120 moves rotatably about the pivot post 86 a slight amount to the right (as depicted in FIG. 6) or left with respect to the end plate 84, the nibs 114, 114' being mechanical stops bearing on the interior surface of the housing 120 to limit relative movement between the housing 120 and the end plate 84. When so actuated the nib 136 bears on the blade 138 of actuating spring 96; the spring 96 is forced to pivot about pin 88 dropping away from pin 89 to actuate the plunger 112 of the switch 110. When actuated in the opposite direction than shown in FIG. 6, the pin 89 becomes the pivot for the spring 96, the right-hand blade 138' being actuated by nib 136' and the other blade 138 falling away from the left-hand pin 88.

Figure 5A:
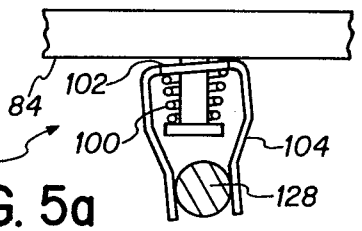
FIG. 5A shows the knob-tension mechanism of FIG. 5 when the knob assembly is operated to actuate the switch.
Figure 5:
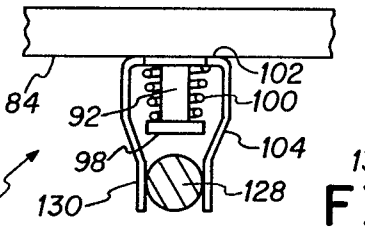
FIG. 5 is a modified sectional view taken generally along lines 5—5 of FIG. 4 showing the knob-tension mechanism of the present invention.

When the pilot releases the knob assembly 80, the housing 120 and end plate 84 are forced back to their neutral position (as shown in FIG. 4) by the knob-tension assembly 132. Referring now to FIG. 5A, the knob-tension assembly 132 is shown with the knob assembly actuated. The base 102 of the knob-tension spring 104 is rocked away from its unactuated position abutting the end plate 84 by lateral movement of the knob-tension pin 128. The knob-tension spring 104 rocked away from the end plate 84 compresses the coil spring 100. The force exerted by the compressed coil spring 100 provides energy in addition to energy of a spring (not shown) inside the switch 110 for positively returning the knob assembly 120 to the neutral position with respect to the end plate 84, thereby deactuating the switch 110. The actuating mechanism described infra provides positive action to actuate the pressure sensitive switch 110 with a minimum amount of pressure applied by the pilot and with minuscule movement of the throttle knob. The force required is so slight (as little as 5.7 g/m) and the movement so small that the pilot is virtually unaware of any tactile sensation of switch operation, particularly after using the apparatus for a short time.

Referring again to FIGS. 3 and 7, an end cap 140 attaches to the thickened portion 122 of the housing 120 by suitable fastening means (not shown) such as bolts passed through apertures 142 in the cap 140. A push-button switch 144 mounted on the end cap 140 serves as a novel safety feature not seen in known autothrottle systems, whereby actuation of the switch 144 by the pilot serves to disengage the autothrottle system without releasing grip on the throttle knob 80. Using the push-button switch 144 to disengage the autothrottle system disables the system until it is enabled again by the pilot utilizing a cockpit control panel switch, as opposed to the temporary disengagement effected through actuation of the switch 110 as described infra. The feature allows the pilot, upon sensing an anomaly in the flight control system while manually adjusting the throttles, to disengage the autothrottle system without being required to unhand the throttle knob for the purpose of actuating a release button located elsewhere in the cockpit. The push button 146 is suitably recessed inside the cylindrical housing 120 to reduce the possibility of accidental actuation of the switch 144.

While the principles of my invention have now been made clear in the foregoing illustrative embodiments, there will be immediately obvious to those skilled in the art many modifications of structure, arrangement, proportions, the elements, material and components used in the practice of the invention, and otherwise, which are particularly adapted for specific environments and operating requirements without departing from those principles. The appended claims are, therefore, intended to cover and embrace any such modifications, within the limits only of the true spirit and scope of my invention.

What is claimed is:

1. A switch actuating mechanism, comprising:

a graspable housing;

plate means for pivotally attaching said housing to a manually operable lever, said housing pivotally movable in either of two opposite directions with respect to said lever when said lever is operated by grasping said housing;

a first electrical switch attached to said plate means; and spring means mounted between said housing and said plate means for actuating said first switch in response to the movement of said housing with respect to said lever.

2. A switch actuating mechanism as claimed in claim 1, further comprising:

second spring means mounted intermediate said housing and said plate means for returning said housing to a neutral position releasing said first switch from said actuating means.

3. The switch actuating mechanism as claimed in claim 1 or 2, further comprising:

a second electrical switch mounted recessed inside said housing, said second switch manually operable independently of said first switch.

4. Means for detecting force manually applied to a graspable lever, comprising:

an end plate having a circularly shaped portion and a pivot, said end plate attached to an end of the lever in a plane parallel with a plane of actuation of said lever, the pivot being perpendicular to said end plate;

a cylindrical housing pivotally attached to the pivot of said end plate, and cylindrical housing having a central axis aligned perpendicularly with the plane of actuation of said lever, the pivot being near the perphery of said housing, the circularly shaped portion of said end plate extending inside said housing;

first and second pivot pins affixed to said end plate inside said housing, the pins being parallel with and spaced apart equidistant from the pivot of said end plate;

a flat spring having a central actuating member and two blades bent to form a squared U-shaped structure, interior corners of the squared structure wrapped around said pivot pins, the central actuating member extending between said pivot pins, said housing including a pair of interiorly facing actuating nibs, each abutting one of the exteriorly facing blades of the U-shaped spring, the actuating nibs of said housing arranged to move laterally with respect to said blades when said housing moves pivotally with respect to said end plate; and a pressure sensitive switch mounted on said end plate inside the housing, an actuating plunger of said switch abutting said central actuating member midway between said pivot pins, said lateral movement of said nibs in a first direction forcing said spring to pivot about said first pivot pin, the central actuating member of said spring actuating the plunger of said switch, said lateral movement of said nibs in a second direction forcing said spring to pivot about said second pivot pin, the central actuating member of said spring again actuating the plunger of said switch.

* * * * *